US007369088B2

(12) United States Patent
Kushihi

(10) Patent No.: US 7,369,088 B2
(45) Date of Patent: May 6, 2008

(54) CIRCULARLY POLARIZED MICROSTRIP ANTENNA AND RADIO COMMUNICATION APPARATUS INCLUDING THE SAME

(75) Inventor: Yuichi Kushihi, Kanazawa (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 11/519,040

(22) Filed: Sep. 12, 2006

(65) Prior Publication Data

US 2007/0008226 A1 Jan. 11, 2007

Related U.S. Application Data

(63) Continuation of application No. PCT/JP2005/005550, filed on Mar. 25, 2005.

(30) Foreign Application Priority Data

May 27, 2004 (JP) ..... 2004-157983

(51) Int. Cl.
*H01Q 1/38* (2006.01)

(52) U.S. Cl. ..... 343/700 MS

(58) Field of Classification Search ..... 343/700 MS, 343/702, 846

See application file for complete search history.

(56) References Cited

U.S. PATENT DOCUMENTS 4,890,693 A 1/1990 O'Brien
4,980,693 A 12/1990 Wong et al.
5,287,116 A * 2/1994 Iwasaki et al. ..... 343/700 MS
5,712,644 A * 1/1998 Kolak ..... 343/700 MS

FOREIGN PATENT DOCUMENTS

| | | |
|---|---|---|
| JP | 63-50203 | 3/1988 |
| JP | 1-147905 | 6/1989 |
| JP | 6-29725 | 2/1994 |
| JP | 6-276014 | 9/1994 |
| JP | 10-93330 | 4/1998 |
| JP | 63-135003 | 6/1998 |

(Continued)

OTHER PUBLICATIONS

International Search Report PCT/JP2005/005550, May 24, 2005.

(Continued)

*Primary Examiner*—Michael C. Wimer
(74) *Attorney, Agent, or Firm*—Dickstein Shapiro LLP

(57) ABSTRACT

A circularly polarized microstrip antenna includes a dielectric substrate having only an emitting electrode for generating circularly polarized waves on a front surface of the dielectric substrate and a coplanar signal line for feeding the emitting electrode and a ground electrode on a back surface of the dielectric substrate. The ground electrode covers the entire area of the back surface of the dielectric substrate excluding a region in which the signal line is provided. The signal line extends from an edge of the back surface of the dielectric substrate to an intermediate position between the edge of the back surface of the dielectric substrate and a center position O of the emitting electrode on the back surface of the dielectric substrate. Thus, a circularly polarized microstrip antenna whose circular polarization characteristic can be easily improved and whose manufacturing cost and size can be easily reduced is provided.

18 Claims, 6 Drawing Sheets

FOREIGN PATENT DOCUMENTS

| | | |
|---|---|---|
| JP | 10-209743 | 8/1998 |
| JP | 10-233621 | 9/1998 |
| JP | 3002252 | 11/1999 |
| JP | 2000-183637 | 6/2000 |
| JP | 2001-177314 | 6/2001 |
| JP | 2002-261539 | 9/2002 |
| JP | 2003-115717 | 4/2003 |
| JP | 3445431 | 6/2003 |
| JP | 2003-198240 | 7/2003 |
| JP | 2004-23698 | 1/2004 |
| JP | 2004-32014 | 1/2004 |

OTHER PUBLICATIONS

Written Opinion PCT/JP2005/005550, May 24, 2005.

* cited by examiner

CIRCULARLY POLARIZED MICROSTRIP ANTENNA AND RADIO COMMUNICATION APPARATUS INCLUDING THE SAME

CROSS REFERENCE TO RELATED APPLICATIONS

The present application is a continuation of International Application No. PCT/JP2005/005550, filed Mar. 25, 2005, which claims priority to Japanese Patent Application No. JP2004-157983, filed May 27, 2004, the entire contents of each of these applications being incorporated herein by reference in their entirety.

FIELD OF THE INVENTION

The present invention relates to a circularly polarized microstrip antenna for performing radio communication using circularly polarized waves and a radio communication apparatus including the circularly polarized microstrip antenna.

BACKGROUND OF THE INVENTION

FIG. 8*a* illustrates a perspective view of an example of a circularly polarized antenna structure, and FIG. 8*b* illustrates a schematic sectional view of the circularly polarized antenna structure shown in FIG. 8*a* (see, for example, Patent Document 1). This circularly polarized antenna structure 30 includes a dielectric substrate 31. An emitting electrode 32 for generating circularly polarized waves is formed on a front surface of the dielectric substrate 31 and a ground electrode 33 is formed on a back surface of the dielectric substrate 31 so as to cover substantially the entire area thereof. An electrode-free region through which a feeding pin 34 is inserted is formed in the ground electrode 33, and the feeding pin 34 is inserted into the dielectric substrate 31 through the electrode-free region. The feeding pin 34 is electromagnetically coupled to the emitting electrode 32 via a capacitance. The feeding pin 34 is connected to an internal conductor of a feeding coaxial cable so that the feeding pin 34 is connected to, for example, a high-frequency radio communication circuit (not shown) included in a radio communication apparatus via the feeding coaxial cable.

In this circularly polarized antenna structure 30, when, for example, a transmission signal is supplied from the high-frequency radio communication circuit in the radio communication apparatus to the feeding pin 34 via the feeding coaxial cable, the transmission signal is transmitted from the feeding pin 34 to the emitting electrode 32 due to the electromagnetic coupling therebetween. Accordingly, the emitting electrode 32 is excited and circularly polarized waves are generated, so that the signal is wirelessly transmitted.

FIG. 9*a* illustrates a schematic plan view of another example of a circularly polarized antenna structure, and FIG. 9*b* illustrates a schematic sectional view of FIG. 9*a* taken along line A-A (see, for example, Patent Document 2). This circularly polarized antenna structure 36 includes a dielectric substrate 37. An emitting electrode 38 for generating circularly polarized waves and a feeding electrode 39 that extends from the emitting electrode 38 are formed on a front surface of the dielectric substrate 37. In addition, a signal line 40, which is a coplanar line (CPW line), is formed on a back surface of the dielectric substrate 37 so as to extend from an edge of the back surface of the dielectric substrate 37 to a position where the signal line 40 faces the feeding electrode 39. In addition, a ground electrode 41 is formed on the back surface of the dielectric substrate 37 such that the ground electrode 41 covers substantially the entire area excluding the region where the signal line 40 is formed and a gap is provided between the ground electrode 41 and the signal line 40.

The coplanar signal line 40 is electromagnetically coupled to the feeding electrode 39. In addition, the signal line 40 is connected to a high-frequency radio communication circuit (not shown) included in a radio communication apparatus. When a transmission signal is supplied from the high-frequency circuit to the signal line 40, the transmission signal is transmitted from the signal line 40 to the feeding electrode 39 due to the electromagnetic coupling between the signal line 40 and the feeding electrode 39, and is then transmitted from the feeding electrode 39 to the emitting electrode 38. Accordingly, the emitting electrode 38 is excited and circularly polarized waves are generated, so that the transmission signal is wirelessly transmitted.

FIG. 10*a* illustrates a schematic plan view of another example of a circularly polarized antenna structure, and FIG. 10*b* illustrates a schematic sectional view of FIG. 10*a* taken along line B-B (see, for example, Patent Document 3). This circularly polarized antenna structure 43 includes a dielectric substrate 44. An emitting electrode 45 for generating circularly polarized waves is formed on a front surface of the dielectric substrate 44. A feeding electrode 46 is formed on a back surface of the dielectric substrate 44 so as to extend from an edge of the back surface of the dielectric substrate 44 to a center position of the emitting electrode 45 on the back surface of the dielectric substrate 44. In addition, a ground electrode 47 is formed on the back surface of the dielectric substrate 44 such that the ground electrode 47 covers substantially the entire area of the back surface of the dielectric substrate 44 excluding the region where the feeding electrode 46 is formed and a gap is provided between the feeding electrode 46 and the ground electrode 47.

Patent Document 1: Japanese Unexamined Patent Application Publication No. 2004-32014

Patent Document 2: Japanese Unexamined Patent Application Publication No. 10-93330

Patent Document 3: Japanese Patent No. 3002252

Patent Document 4: Japanese Unexamined Patent Application Publication No. 1-147905

In the antenna structure 30 shown in FIGS. 8*a* and 8*b*, the feeding pin 34 is used. Therefore, it is necessary to insert the feeding pin 34 into the dielectric substrate 31 after the emitting electrode 32 and the ground electrode 33 are formed on the dielectric substrate 31 in the manufacturing process, and thus the manufacturing process is complex. In addition, in the antenna structure 30, the emitting electrode 32 and the feeding pin 34 are preferably electromagnetically coupled to each other while impedance matching is obtained. To provide impedance matching between the emitting electrode 32 and the feeding pin 34, an end of the feeding pin 34 must be precisely positioned with respect to the emitting electrode 32 so that the distance between the emitting electrode 32 and the feeding pin 34 is set to a predetermined distance for impedance matching. However, in mass production, for example, it is extremely difficult to insert the feeding pin 34 into the dielectric substrate 31 as designed in all of the products. Therefore, the distance between the emitting electrode 32 and the feeding pin 34 varies depending on the product and the condition of impedance matching between the emitting electrode 32 and the feeding pin 34 varies accordingly. Since the radio communication performance varies depending on the condition of impedance matching between the emitting electrode 32 and the feeding pin 34, reliability of performance cannot be ensured.

In addition, the antenna structure 30 is connected to the high-frequency radio communication circuit in the radio communication apparatus using the coaxial cable. Therefore, there are problems that a cumbersome task of connecting the coaxial cable to the antenna structure 30 is necessary and the manufacturing cost is increased.

In the antenna structure 36 shown in FIGS. 9*a* and 9*b*, not only the emitting electrode 38 but also the feeding electrode 39 is formed on the front surface of the dielectric substrate 37. Since the feeding electrode 39 must be formed, it is difficult to reduce the size of the dielectric substrate 37.

In the antenna structure 43 shown in FIGS. 10*a* and 10*b*, the feeding electrode 46 is formed so as to extend from the edge of the back surface of the dielectric substrate 44 to the center position of the emitting electrode 45 on the back surface of the dielectric substrate 44. Therefore, there is a problem that satisfactory resonance for generating the circularly polarized waves cannot be obtained by the emitting electrode 45 because of the reason described below and it is difficult for the antenna structure 43 to function as a circularly polarized antenna.

A current (resonance current) that flows in the emitting electrode 45 travels along linear paths that pass through the center O of the emitting electrode 45, for example, along paths shown by dashed lines $\alpha$ and $\alpha'$ in a plan view of FIG. 10*c*. Accordingly, an image current that is induced by the resonance current in the emitting electrode 45 and that flows in the ground electrode 47 preferably travels along the paths $\alpha$ and $\alpha'$ of the resonance current in the emitting electrode 45, that is, the linear paths that pass through the center position O of the emitting electrode 45. However, since the feeding electrode 46 formed on the back surface of the dielectric substrate 44 extends to the center position O of the emitting electrode 45 and the ground electrode 47 is not formed in a region around the center position O of the emitting electrode 45, the image current in the ground electrode 47 travels along paths that go around the feeding electrode 46, as shown by solid lines $\beta$ and $\beta'$ in FIG. 10*c*. More specifically, unlike the resonance current in the emitting electrode 45, the image current cannot travel along the linear paths that pass through the center position O of the emitting electrode 45. Therefore, the length of the paths along which the image current travels is longer than the length of the paths along which the resonance current travels in the emitting electrode 45. For this reason, satisfactory resonance for generating the circularly polarized waves cannot be obtained by the emitting electrode 45.

SUMMARY OF THE INVENTION

In order to solve the above-described problems, the present invention provides the following structure. That is, according to the present invention, a circularly polarized microstrip antenna includes a dielectric substrate having only a $\lambda/2$-type emitting electrode for generating circularly polarized waves on a front surface of the dielectric substrate and a coplanar signal line for feeding the emitting electrode and a ground electrode on a back surface of the dielectric substrate, the signal line being electromagnetically coupled to the emitting electrode and the ground electrode covering the entire area of the back surface of the dielectric substrate excluding a region in which the signal line is provided. The signal line extends from an edge of the back surface of the dielectric substrate to an intermediate position between the edge of the back surface of the dielectric substrate and a center position of the emitting electrode on the back surface of the dielectric substrate. In addition, a radio communication apparatus according to the present invention includes the circularly polarized microstrip antenna having the characteristic structure of the present invention.

According to the present invention, the coplanar signal line provided on the back surface of the dielectric substrate extends from an edge of the back surface of the dielectric substrate to an intermediate position between the edge of the back surface of the dielectric substrate and a center position of the emitting electrode on the back surface of the dielectric substrate. In other words, the length of the signal line for feeding the emitting electrode according to the present invention is shorter than the length of a signal line for feeding an emitting electrode that extends from en edge of a back surface of a dielectric substrate to a center position of the emitting electrode on the back surface of the dielectric substrate. Therefore, according to the present invention, a portion of the signal line that overlaps the emitting electrode can be reduced in length or eliminated.

As the length of the portion of the signal line that overlaps the emitting electrode is reduced, the signal line can be moved further away from ideal paths for the image current in the ground electrode. Therefore, according to the structure of the present invention, the image current can travel in the ground electrode along paths that pass through the center position of the emitting electrode without being obstructed by the signal line for feeding the emitting electrode. Accordingly, the paths along which the image current travels in the ground electrode can be prevented from becoming longer than the paths along which the resonance current travels in the emitting electrode. Therefore, satisfactory resonance for generating the circularly polarized waves can be obtained by the emitting electrode.

In particular, when the signal line for feeding the emitting electrode is structured such that the signal line does not overlap the emitting electrode, the signal line for feeding the emitting electrode is prevented from obstructing the paths of the image current. Accordingly, the resonance can be more reliably obtained by the emitting electrode and the circular polarization characteristic can be improved. As a result, a circularly polarized microstrip antenna with high radio communication reliability can be provided.

In addition, according to the present invention, the emitting electrode is formed on the front surface of the dielectric substrate and the coplanar signal line for feeding the emitting electrode is formed on the back surface of the dielectric substrate. The emitting electrode and the signal line for feeding the emitting electrode can be easily formed on the front and back surfaces of the dielectric substrate with high precision using etching or screen printing techniques. In addition, the dielectric substrate can also be easily manufactured with high precision. Therefore, the gap between the emitting electrode and the signal line for feeding the emitting electrode can be set substantially equal to a designed value without errors. Accordingly, the capacity between the emitting electrode and the signal line for feeding the emitting electrode can be set substantially equal to a designed capacity. As a result, the emitting electrode and the signal line for feeding the emitting electrode can be electromagnetically coupled to each other while suitable impedance matching is obtained as designed, and the antenna gain can be increased. This also increases the radio communication reliability.

In addition, according to the present invention, the emitting electrode is a $\lambda/2$-type emitting electrode. Therefore, it is not necessary to link the emitting electrode to the ground. Accordingly, it is not necessary to form electrodes on the side surfaces of the dielectric substrate in order to link the emitting electrode to the ground electrode. In other words, according to the present invention, the λ/2-type emitting electrode is formed only on the front surface of the dielectric substrate, and no electrodes are formed on the side surfaces of the dielectric substrate. Therefore, it is not necessary to perform steps of forming electrodes on the side surfaces of the dielectric substrate in the manufacturing process. Thus, the manufacturing process is facilitated and the manufacturing cost is reduced.

In addition, according to the present invention, only the emitting electrode is formed on the front surface of the dielectric substrate. Therefore, compared to the structure in which an element other than the emitting electrode is additionally formed on the front surface of the dielectric substrate, the size of the dielectric substrate can be easily reduced (that is, the size of the microstrip antenna can be easily reduced).

On the other hand, antennas having a tri-plate structure (i.e., antennas having a three-layer structure including an emitting electrode, a feeding electrode, and a ground electrode disposed with dielectric layers interposed therebetween) are suggested (see, for example, Patent Document 4). In this structure, the emitting electrode, the feeding electrode, and the ground electrode are arranged at different layer positions. Therefore, the manufacturing process is complex and the material cost is increased since the number of dielectric layers is increased. In comparison, according to the present invention, since the signal line for feeding the emitting electrode and the ground electrode are both formed on the back surface of the dielectric substrate, the signal line for feeding the emitting electrode and the ground electrode can be formed simultaneously. Accordingly, the manufacturing process can be simplified. In addition, since the amount of dielectric material used can be reduced, the material cost can be reduced.

REFERENCE NUMERALS

1: circularly polarized microstrip antenna
2: dielectric substrate
3: emitting electrode
4: coplanar signal line for feeding emitting electrode
5: ground electrode

DETAILED DESCRIPTION OF THE INVENTION

Embodiments of the present invention will be described below with reference to the accompanying drawings.

Figure 1A:
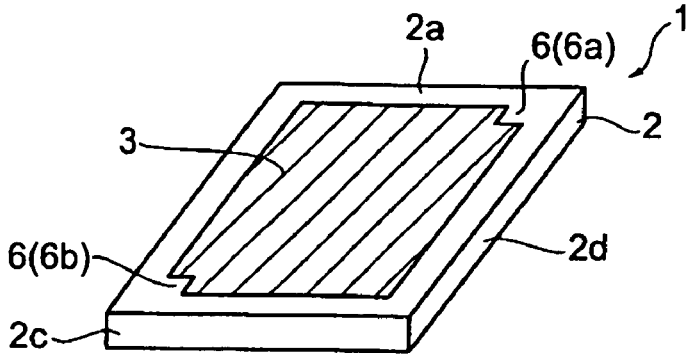
FIG. 1*a* is a perspective view of a circularly polarized microstrip antenna according to a first embodiment.
Figure 1B:
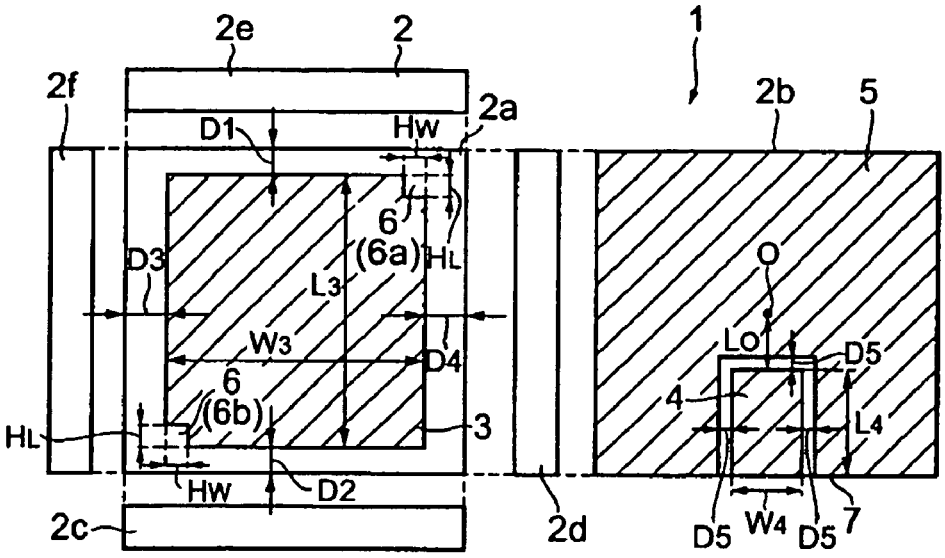
FIG. 1*b* is an exploded view of the circularly polarized microstrip antenna according to the first embodiment.
Figure 1C:
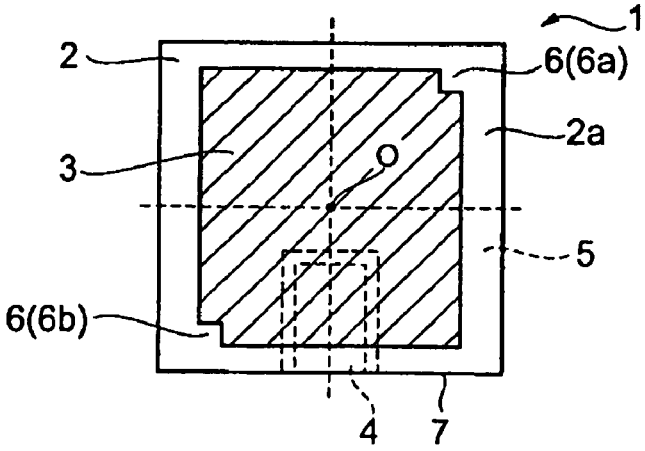
FIG. 1*c* is a plan view of the circularly polarized microstrip antenna according to the first embodiment.

FIG. 1*a* is a schematic perspective view of a circularly polarized microstrip antenna according to a first embodiment. FIG. 1*b* is a schematic development of the circularly polarized microstrip antenna shown in FIG. 1*a*. FIG. 1*c* is a schematic top plan view of the circularly polarized microstrip antenna shown in FIG. 1*a*.

A circularly polarized microstrip antenna 1 according to the first embodiment includes a dielectric substrate 2. The dielectric substrate 2 has a rectangular plate-like shape. The dielectric substrate 2 is composed of a dielectric material with a dielectric constant of 6 or more. An emitting electrode 3 is formed on a front surface 2*a* of the dielectric substrate 2. A coplanar signal line 4 for feeding the emitting electrode 3 is formed on a back surface 2*b* of the dielectric substrate 2. In addition, a ground electrode 5 is formed on the back surface 2*b* of the dielectric substrate 2 such that the ground electrode 5 covers substantially the entire area excluding the region where the signal line 4 is formed and a gap is provided between the ground electrode 5 and the signal line 4. No conductor, such as an electrode, is formed on any of side surfaces 2*c* to 2*f* of the dielectric substrate 2, and the side surfaces 2*c* to 2*f* function as conductor-free areas.

The emitting electrode 3 is a substantially square-shaped λ/2-type emitting electrode (i.e., an emitting electrode having an electrical length of about one-half the wavelength λ of electric waves used for radio communication). In the circularly polarized microstrip antenna 1 according to the first embodiment, a single-point feeding method is used (only one coplanar signal line 4 is formed for feeding the emitting electrode 3). Therefore, the emitting electrode 3 has cutouts 6 (6*a* and 6*b*) for causing degeneracy breaking at two opposite corners thereof. Accordingly, degeneracy breaking occurs in the emitting electrode 3 so that the emitting electrode 3 can generate circularly polarized waves for radio communication. In the first embodiment, as described above, the dielectric constant of the dielectric substrate 2 is 6 or more. Therefore, the dielectric substrate 2 exhibits a strong wavelength-reducing effect and the size of the emitting electrode 3, etc., can be reduced accordingly. As a result, the size of the circularly polarized microstrip antenna 1 can be reduced.

The signal line 4 for feeding the emitting electrode 3 is coplanar with the ground electrode 5. The signal line 4 linearly extends from a side (edge) 7 of the back surface 2*b* of the square-shaped dielectric substrate 2 to an intermediate position between the side (edge) 7 and the center position O of the emitting electrode 3 on the back surface 2*b* of the dielectric substrate 2. The length of the signal line 4 is associated with the amount of electromagnetic coupling between the signal line 4 and the emitting electrode 3, and is set to an adequate length so that the signal line 4 and the emitting electrode 3 can be electromagnetically coupled to each other while impedance matching is obtained.

An example of the structure according to the first embodiment will be described below. In this example, the dielectric constant of the dielectric substrate 2 is 6 and the size of the dielectric substrate 2 is 10 mm×10 mm×1 mm. The emitting electrode 3 is a rectangular λ/2-type emitting electrode. The width $W_3$ (see FIG. 1*b*) of the emitting electrode 3 is 7.55 mm and the length $L_3$ thereof is 8 mm. The emitting electrode 3 is formed such that the center position of the emitting electrode 3 substantially coincides with the center position of the dielectric substrate 2. Therefore, dimensions D1 and D2 of the electrode-free regions between the edges of the dielectric substrate 2 along the width thereof and the corresponding edges of the emitting electrode 3 along the width thereof are both 1 mm. In addition, dimensions D3 and D4 of the electrode-free regions between the edges of the dielectric substrate 2 along the length thereof and the corresponding edges of the emitting electrode 3 along the length thereof are both 1.225 mm.

The width $H_W$ of the cutouts 6 (6*a* and 6*b*) is 0.7 mm and the length $H_L$ thereof is 0.6 mm. The width $W_4$ of the coplanar signal line 4 for feeding the emitting electrode 3 is 1.8 mm and the length $L_4$ thereof is 3 mm. The gap D5 between the signal line 4 and the ground electrode 5 surrounding the signal line 4 is 0.5 mm. The distance $L_O$ between an inner end of the signal line 4 and the center position O of the emitting electrode 3 on the back surface 2*b* of the dielectric substrate 2 is 2 mm. Thus, the signal line 4 extends to an intermediate position between the edge of the emitting electrode 3 and the center position O thereof.

Figure 2:
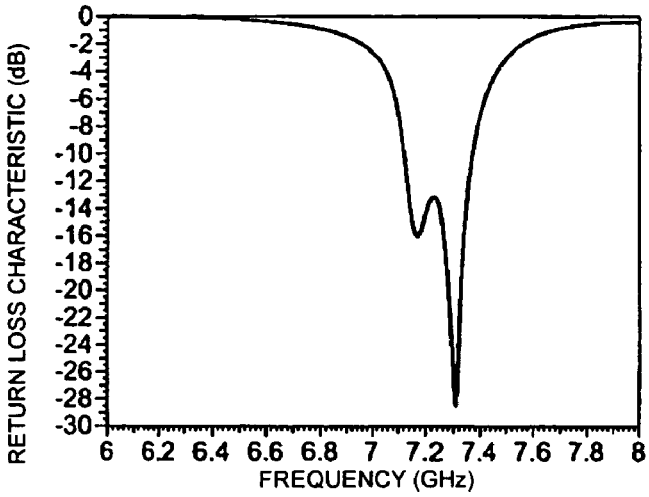
FIG. 2 is a graph showing an example of a return loss characteristic obtained by simulation of a circularly polarized microstrip antenna having the structure according to the first embodiment.

The inventors of the present invention performed a simulation for obtaining the return-loss characteristic and the axial ratio of the circularly polarized microstrip antenna 1 having the above-described structure. FIG. 2 is a graph showing the result of simulation of the return-loss characteristic. The axial ratio of the circularly polarized waves in a direction perpendicular to the emitting electrode 3 (zenithal direction) was 1.4 dB. As is clear from these results, the circularly polarized microstrip antenna 1 having the above-described structure can provide good radio communication using circularly polarized waves at a frequency around 7.3 GHz.

In this example, the signal line 4 extends from the edge of the back surface 2*b* of the dielectric substrate 2 to an intermediate position between the edge of the emitting electrode 3 and the center position O thereof. However, the position to which the signal line 4 extends is not limited to the intermediate position between the edge of the emitting electrode 3 and the center position O thereof. The length of the signal line 4 is set such that suitable impedance matching can be obtained between the signal line 4 and the emitting electrode 3. The length of the signal line 4 for obtaining suitable impedance matching between the signal line 4 and the emitting electrode 3 differs depending on the dielectric constant of the dielectric substrate 2, a predetermined frequency used for radio communication, etc. Therefore, the length of the signal line 4 is not limited to the distance from the edge of the dielectric substrate 2 to the intermediate position between the edge of the emitting electrode 3 and the center position O thereof. For example, the signal line 4 may extend closer to the center position O of the emitting electrode 3 beyond the above-mentioned intermediate position. Alternatively, the signal line 4 may extend from the edge of the dielectric substrate 2 to a position before the above-mentioned intermediate position between the edge of the emitting electrode 3 and the center position O thereof. As an example, FIG. 3*a* shows an exploded view of another example and FIG. 3*b* shows a schematic top plan view of the circularly polarized microstrip antenna 1 shown in FIG. 3*a*.

Figure 3A:
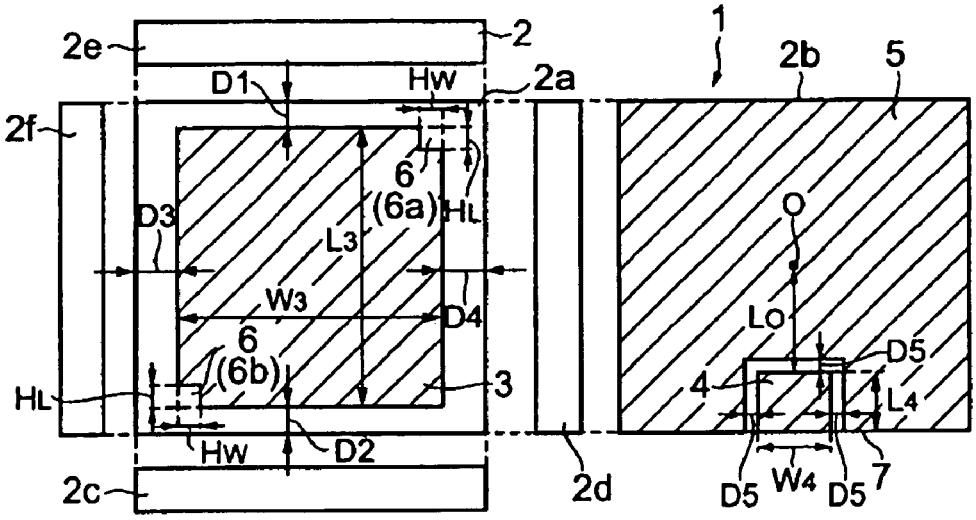
FIG. 3*a* is an exploded view illustrating an example of a circularly polarized microstrip antenna that is different from the circularly polarized microstrip antenna shown in FIGS. 1*a* to 1*c* and that has a characteristic structure according to the first embodiment.
Figure 3B:
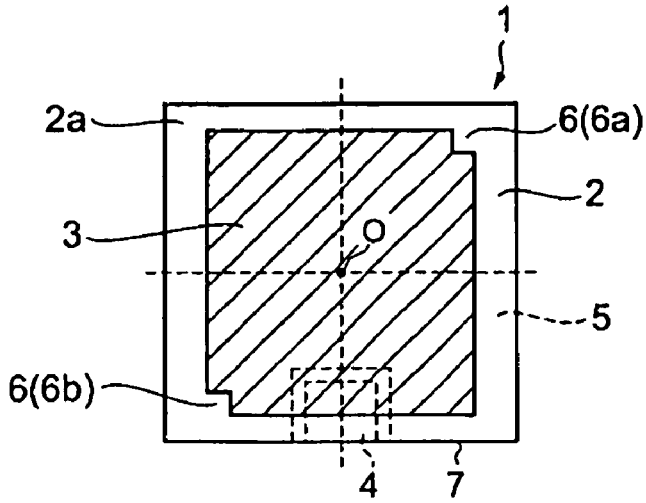
FIG. 3*b* is a plan view of the circularly polarized microstrip antenna shown in FIG. 3*a*.

In the example shown in FIGS. 3*a* and 3*b*, the dielectric constant of the dielectric substrate 2 is 20 and the size of the dielectric substrate 2 is 10 mm×10 mm×1 mm. The emitting electrode 3 is a substantially rectangular λ/2-type emitting electrode. The width $W_3$ (see FIG. 3*a*) of the emitting electrode 3 is 7.72 mm and the length $L_3$ thereof is 8 mm. The emitting electrode 3 is formed such that the center position of the emitting electrode 3 substantially coincides with the center position of the dielectric substrate 2. Therefore, dimensions D1 and D2 of the electrode-free regions between the edges of the dielectric substrate 2 along the width thereof and the corresponding edges of the emitting electrode 3 along the width thereof are both 1 mm. In addition, dimensions D3 and D4 of the electrode-free regions between the edges of the dielectric substrate 2 along the length thereof and the corresponding edges of the emitting electrode 3 along the length thereof are both 1.14 mm.

The width $H_W$ of the cutouts 6 (6*a* and 6*b*) is 0.6 mm and the length $H_L$ thereof is 0.4 mm. The width $W_4$ of the coplanar signal line 4 for feeding the emitting electrode 3 is 2.2 mm and the length $L_4$ thereof is 1.6 mm. The gap D5 between the signal line 4 and the ground electrode 5 surrounding the signal line 4 is 0.5 mm. The distance $L_O$ between the inner end of the signal line 4 and the center position O of the emitting electrode 3 on the back surface 2*b* of the dielectric substrate 2 is 3.4 mm. In other words, the length of the signal line 4 is shorter than that in the structure shown in FIGS. 1*a* to 1*c*, and accordingly the length of a portion of the signal line 4 that overlaps the emitting electrode 3 is reduced.

Figure 4:
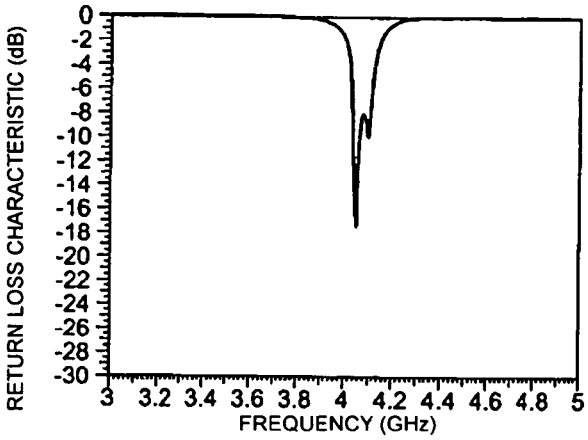
FIG. 4 is a graph showing an example of a return loss characteristic of the circularly polarized microstrip antenna shown in FIGS. 3*a* and 3*b*.

The return-loss characteristic and the axial ratio of the circularly polarized microstrip antenna 1 having the above-described structure were obtained by simulation. FIG. 4 is a graph showing the result of the simulation of the return-loss characteristic. The axial ratio of the circularly polarized waves in a direction perpendicular to the emitting electrode 3 (zenithal direction) was 2.1 dB. As is clear from these results, circularly polarized microstrip antenna 1 having the above-described structure can provide good radio communication using circularly polarized waves at a frequency around 4.1 GHz and can improve the antenna gain.

A second embodiment will be described below. In the second embodiment, components similar to those of the first embodiment are denoted by the same reference numerals, and redundant explanations thereof are thus omitted.

Figure 5A:
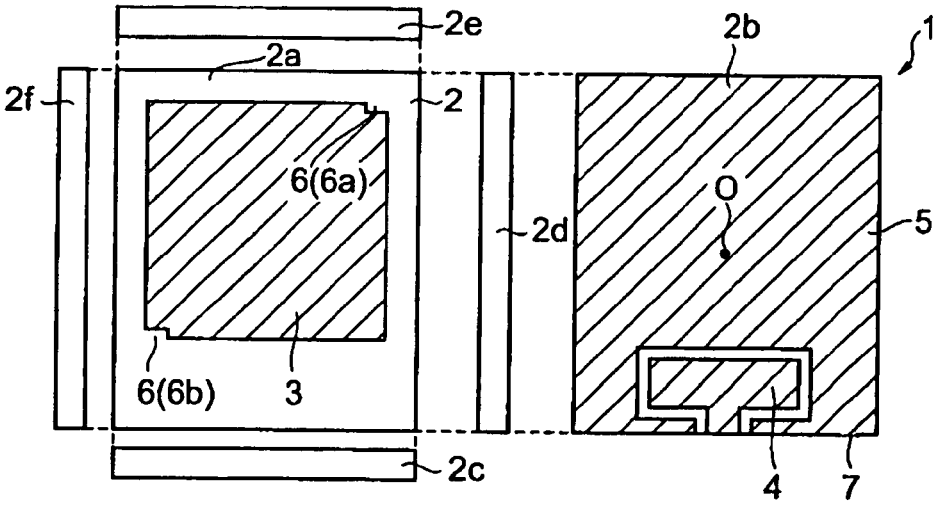
FIG. 5*a* is an exploded view of a circularly polarized microstrip antenna according to a second embodiment.
Figure 5B:
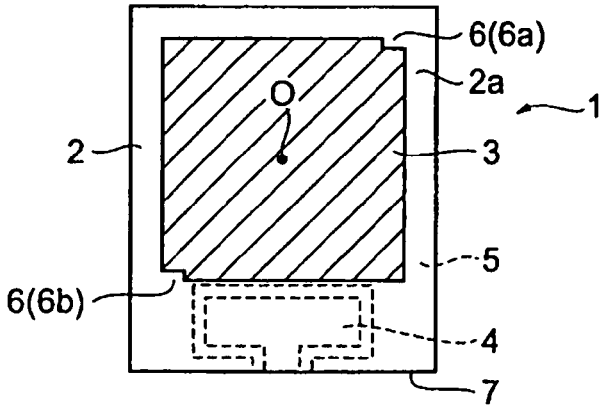
FIG. 5*b* is a plan view of the circularly polarized microstrip antenna according to the second embodiment.

FIG. 5*a* is a schematic development of a circularly polarized microstrip antenna 1 according to a second embodiment. FIG. 5*b* is a schematic top plan view of the circularly polarized microstrip antenna 1 shown in FIG. 5*a*. In the second embodiment, a coplanar signal line 4 for feeding an emitting electrode 3 extends from an edge 7 of a back surface of the dielectric substrate 2 toward the center position O of the emitting electrode 3 on the back surface of the dielectric substrate 2, and an inner end of the signal line 4 is positioned outside the region in which the emitting electrode 3 is formed. More specifically, in the second embodiment, the signal line 4 does not overlap the emitting electrode 3.

In addition, in the second embodiment, the signal line 4 is shaped such that the width at an inner end thereof is larger than the width at an end on the edge of the back surface of the dielectric substrate 2. In the example shown in FIGS. 5*a* and 5*b*, the signal line 4 is substantially T-shaped. When the width of the signal line 4 at the inner end thereof is larger than the width at the end on the edge of the back surface of the dielectric substrate 2, compared to the case in which the signal line 4 has a constant width that is equal to the width at the edge of the back surface of the dielectric substrate 2 over the entire length thereof, the strength of electromagnetic coupling between the signal line 4 and the emitting electrode 3 can be increased. Therefore, even when the length of the signal line 4 is reduced, the signal line 4 and the emitting electrode 3 can be electromagnetically coupled to each other while impedance matching is obtained therebetween. Accordingly, the structure in which the signal line 4 does not overlap the emitting electrode 3, as in the second embodiment, can be easily obtained.

Figure 10A:
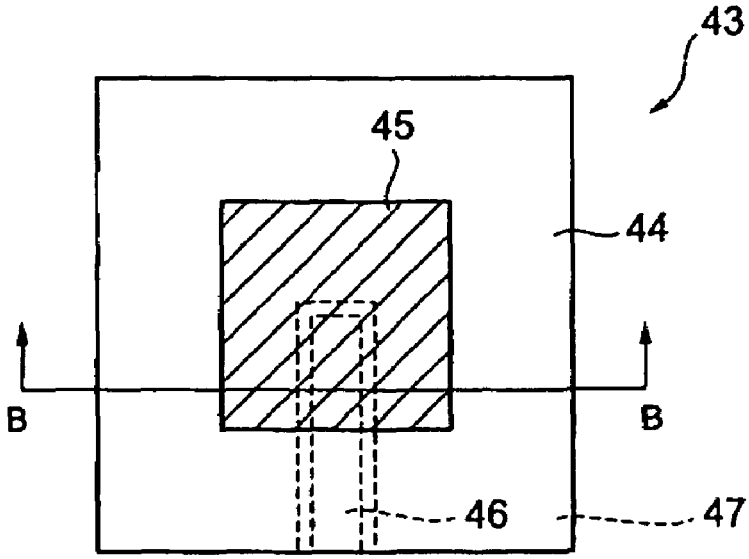
FIG. 10a PRIOR ART
FIG. 10*a* is a plan view illustrating another example of a known circularly polarized antenna structure that is different from the circularly polarized antenna structure shown in FIGS. 8*a* and 8*b*.
Figure 10B:
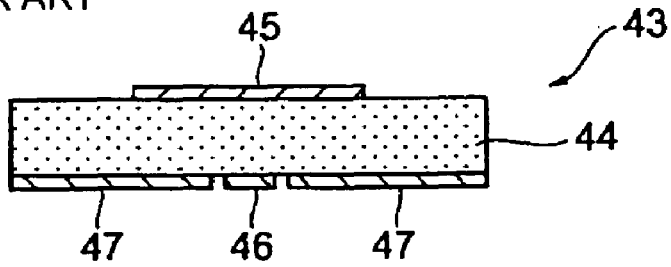
FIG. 10b PRIOR ART
FIG. 10*b* is a schematic sectional view of the circularly polarized antenna structure shown in FIG. 10*a*.
Figure 10C:
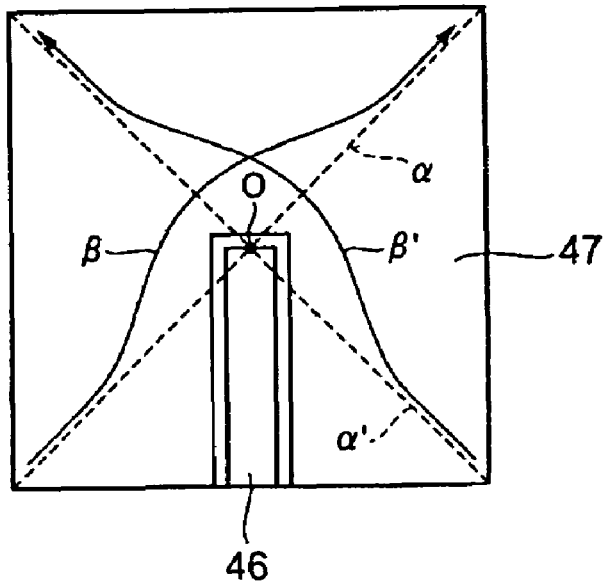
FIG. 10c PRIOR ART
FIG. 10*c* is a schematic bottom plan view of the circularly polarized antenna structure shown in FIG. 10*a*.

When the signal line 4 does not overlap the emitting electrode 3, an image current that flows through the ground electrode 5 can travel along paths that are close to the ideal paths (for example, linear paths that pass through the center position of the emitting electrode, as shown by the dashed lines $\alpha$ and $\alpha'$ in FIG. 10*c*) without being obstructed by the signal line 4. Accordingly, circular polarization characteristic of the circularly polarized microstrip antenna 1 can be improved.

Next, a third embodiment will be described. The third embodiment relates to a radio communication apparatus. The radio communication apparatus according to the third embodiment is characterized in that the circularly polarized microstrip antenna 1 according to the first or second embodiment is included. Other structures of the radio communication apparatus are not particularly limited, and various structures may be used. Therefore, explanations of structures other than the circularly polarized microstrip antenna are omitted. In addition, since the circularly polarized microstrip antennas 1 according to the first and second embodiments are described above, explanations thereof are also omitted.

In the radio communication apparatus according to the third embodiment, since the circularly polarized microstrip antenna 1 according to the first or second embodiment is used, the cost and size of the circularly polarized microstrip antenna 1 can be reduced. Accordingly, the cost and size of the radio communication apparatus can be reduced. In addition, since the radio communication performance of the circularly polarized microstrip antenna 1 is increased, the reliability of radio communication provided by the radio communication apparatus is increased.

Figure 6:
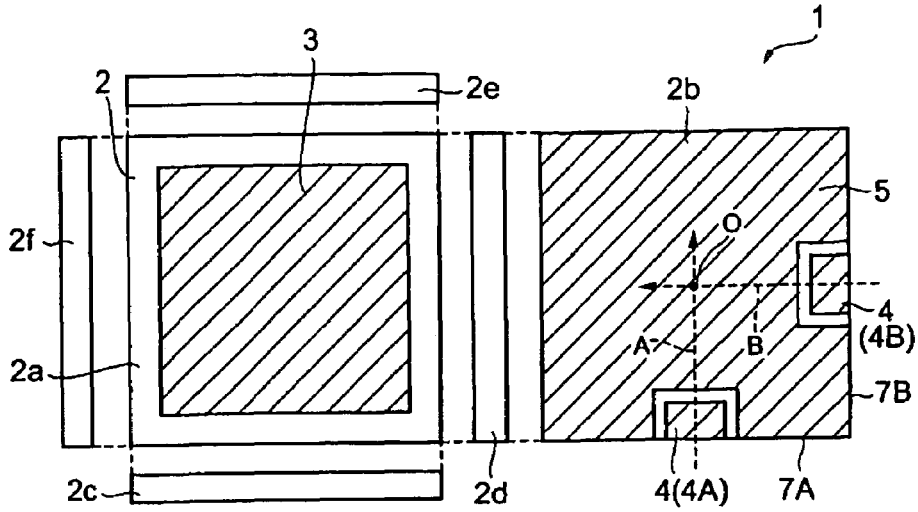
FIG. 6 is a diagram illustrating an embodiment of a circularly polarized microstrip antenna using a two-point feeding method.

The present invention is not limited to the above-described first to third embodiments, and various other embodiments are possible. For example, although the single-point feeding method is used in the circularly polarized microstrip antenna 1 according to each of the first to third embodiments, the present invention may also be applied to circularly polarized microstrip antennas using a two-point feeding method. In such a case, as shown in FIG. 6, which is a schematic development, two coplanar signal lines 4 (4A and 4B) for feeding an emitting electrode are formed in a circularly polarized microstrip antenna 1. These signal lines 4 (4A and 4B) are separated from each other and extend from edges 7A and 7B, respectively, on a back surface 2*b* of a dielectric substrate 2 to intermediate positions between the edges 7A and 7B and a center position O of the emitting electrode on the back surface 2*b* of the dielectric substrate 2. A direction A in which the signal line 4A extends and a direction B in which the signal line 4B extends are orthogonal to each other. The lengths of the signal lines 4 (4A and 4B) are set such that the signal lines 4 (4A and 4B) can be electromagnetically coupled to the emitting electrode 3 while impedance matching is obtained. The signal lines 4 (4A and 4B) may partially overlap the emitting electrode 3. Alternatively, the structure may be such that the signal lines 4 (4A and 4B) do not overlap the emitting electrode 3.

When the two-point feeding method is used, the following advantages can be obtained. That is, the emitting electrode 3 has two different excitation modes for generating the circularly polarized waves, and the two excitation modes are orthogonal to each other when the two-point feeding method is used. Therefore, when one of the two signal lines 4 (4A and 4B) for feeding the emitting electrode is viewed from the other, the one of the two signal lines 4 (4A and 4B) is electromagnetically invisible from the other. In other words, the signal lines 4A and 4B are electromagnetically invisible from each other. Therefore, unlike the structure in which the single-point feeding method is used and only one signal line 4 is provided for feeding the emitting electrode, impedance matching between the signal lines 4 and the emitting electrode 3 can be obtained even when the electromagnetic coupling between the signal lines 4 and the emitting electrode 3 is weak. Accordingly, the lengths by which the signal lines 4 overlap the emitting electrode 3 can be reduced or the structure in which the signal lines 4 do not overlap the emitting electrode 3 can be easily obtained. As a result, the signal lines 4 can be designed such that the signal lines 4 are not disposed on the ideal paths for the image current that flows in the ground electrode 5. Therefore, the image current can travel along paths that are close to the ideal paths and the performance of the circularly polarized microstrip antenna can be improved.

In the second embodiment, the signal line 4 for feeding the emitting electrode 3 does not overlap the emitting electrode 3, and is shaped such that the width at the inner end of the signal line 4 is larger than that at the end on the edge of the bottom surface of the dielectric substrate. However, even when the width of the signal line 4 is constant over the entire length thereof from the end on the edge of the back surface of the dielectric substrate to the inner end, if, for example, the width of the signal line 4 is large and strong electromagnetic coupling can be obtained between the signal line 4 and the emitting electrode 3, the signal line 4 can be structured such that the signal line 4 does not overlap the emitting electrode 3. In addition, even when the width of the signal line 4 at the inner end thereof is larger than that at the end on the edge of the back surface of the dielectric substrate, the signal line 4 may be structured so as to overlap the emitting electrode 3 at the wider end thereof depending on the strength of electromagnetic coupling between the signal line 4 and the emitting electrode 3.

Figure 7A:
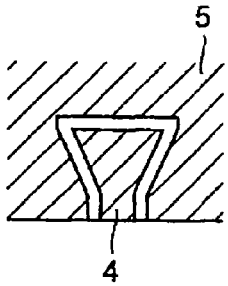
FIG. 7*a* is a model diagram illustrating a modification of a coplanar signal line for feeding an emitting electrode.
Figure 7B:
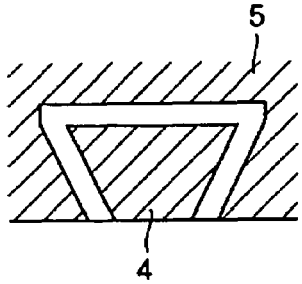
FIG. 7*b* is a model diagram illustrating another modification of a coplanar signal line for feeding an emitting electrode.
Figure 7C:
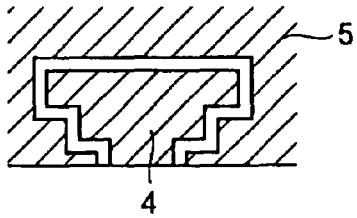
FIG. 7*c* is a model diagram illustrating another modification of a coplanar signal line for feeding an emitting electrode.
Figure 8A:
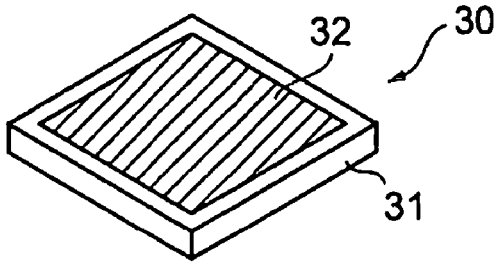
FIG. 8a PRIOR ART
FIG. 8*a* is a perspective view illustrating an example of a known circularly polarized antenna structure.
Figure 8B:
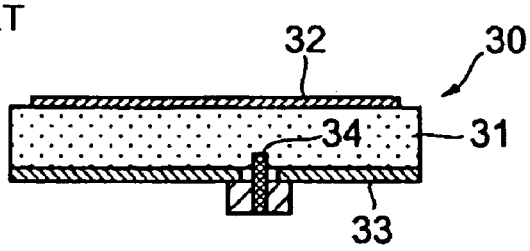
FIG. 8b PRIOR ART
FIG. 8*b* is a schematic sectional view of the circularly polarized antenna structure shown in FIG. 8*a*.
Figure 9A:
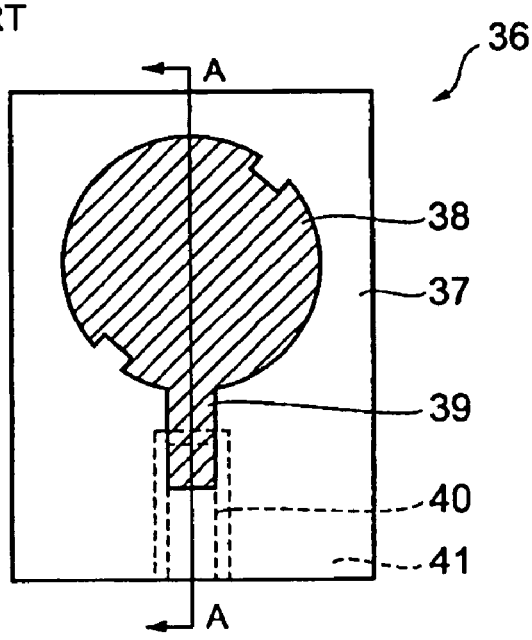
FIG. 9a PRIOR ART
FIG. 9*a* is a plan view illustrating an example of a known circularly polarized antenna structure that is different from the circularly polarized antenna structure shown in FIGS. 8*a* and 8*b*.
Figure 9B:
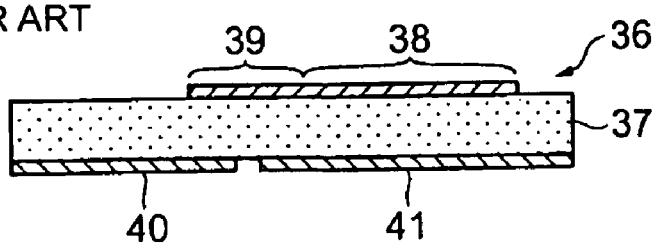
FIG. 9b PRIOR ART
FIG. 9*b* is a schematic sectional view of the circularly polarized antenna structure shown in FIG. 9*a*.

In addition, according to the second embodiment, the signal line 4 is substantially T-shaped. However, the shape of the signal line 4 is not particularly limited as long as the width at the inner end thereof is larger than that at the end on the edge of the back surface of the dielectric substrate. For example, the signal line 4 may also be shaped as shown in FIGS. 7*a*, 7*b*, and 7*c*. In the signal line 4 shown in FIG. 7*a*, the width is constant in a region from the end on the edge of the back surface of the dielectric substrate to an intermediate position of the signal line 4, and is then gradually increased toward the inner end thereof. In the signal line 4 shown in FIG. 7*b*, the width is continuously increased from the end on the edge of the back surface of the dielectric substrate to the inner end. In the signal line 4 shown in FIG. 7*c*, the width is increased stepwise from the end on the edge of the bask surface of the dielectric substrate to the inner end.

In addition, in each of the first to third embodiments, the dielectric substrate 2 is substantially rectangular. However, the dielectric substrate 2 may also have shapes other than rectangle, such as a circular shape, an elliptical shape, a triangular shape, and a polygonal shape with five or more vertices. In addition, the shape of the emitting electrode 3 is also not limited to a substantially square shape as long as the circularly polarized waves can be generated.

According to the structure specific to the present invention, the size and cost of the circularly polarized microstrip antenna and the radio communication apparatus including the circularly polarized antenna can be easily reduced. Therefore, the present invention is applicable to mobile radio communication apparatuses, which are demanded to be smaller, and circularly polarized antennas included in the mobile radio communication apparatuses.

The invention claimed is:

1. A circularly polarized microstrip antenna comprising:

a dielectric substrate;

a λ/2-type emitting electrode that generates circularly polarized waves on a front surface of the dielectric substrate;

a coplanar signal line that feeds the emitting electrode on a back surface of the dielectric substrate; and a ground electrode on the back surface of the dielectric substrate, wherein the signal line is electromagnetically coupled to the emitting electrode and the ground electrode covers the entire area of the back surface of the dielectric substrate excluding a region in which the signal line is provided, wherein the signal line extends from an edge of the back surface of the dielectric substrate to a position between the edge of the back surface of the dielectric substrate and a center position of the emitting electrode on the back surface of the dielectric substrate, and wherein the signal line has a length that allows an image current in the around electrode to travel along paths that pass through the center position of the emitting electrode without being obstructed by the signal line for feeding the emitting electrode.

2. The circularly polarized microstrip antenna according to claim 1, wherein the signal line extends from the edge of the back surface of the dielectric substrate to an intermediate position between the edge of the back surface of the dielectric substrate and the center position of the emitting electrode on the back surface of the dielectric substrate.

3. The circularly polarized microstrip antenna according to claim 1, wherein the dielectric substrate is composed of a dielectric material having a dielectric constant of 6 or more.

4. The circularly polarized microstrip antenna according to claim 1, wherein a width of the coplanar signal line is constant over an entire length thereof.

5. The circularly polarized microstrip antenna according to claim 1, wherein a width of the coplanar signal line at an end of the signal line proximal to the center position is larger than a width of the signal line at the edge of the back surface of the dielectric substrate.

6. The circularly polarized microstrip antenna according to claim 1, wherein a width of the coplanar signal line is constant in a region from an end at the edge of the back surface of the dielectric substrate to an intermediate position of the signal line and is then increases toward an end proximal to the center position.

7. The circularly polarized microstrip antenna according to claim 1, wherein a width of the coplanar signal line continuously increases from an end at the edge of the back surface of the dielectric substrate to an end proximal to the center position.

8. The circularly polarized microstrip antenna according to claim 1, wherein a width of the coplanar signal line increases stepwise from an end at the edge of the back surface of the dielectric substrate to an end proximal to the center position.

9. The circularly polarized microstrip antenna according to claim 1, wherein the coplanar signal line does not overlap the emitting electrode.

10. The circularly polarized micro strip antenna according to claim 1, wherein the dielectric substrate is square-shaped.

11. A radio communication apparatus comprising the circularly polarized microstrip antenna according to claim 1.

12. A circularly polarized microstrip antenna comprising:

a dielectric substrate;

a λ/2-type emitting electrode that generates circularly polarized waves on a front surface of the dielectric substrate;

two coplanar signal lines that feed the emitting electrode formed on the back surface of the dielectric substrate; and a ground electrode on the back surface of the dielectric substrate, wherein the two signal lines are electromagnetically coupled to the emitting electrode and the ground electrode covers the entire area of the back surface of the dielectric substrate excluding a region in which the two signal lines are provided, the two coplanar signal lines being separated from each other and extending in mutually orthogonal directions from different respective edges of the back surface of the dielectric substrate to a position between their respective edge and a center position of the emitting electrode, and wherein the two signal lines have a length that allows an image current in the ground electrode to travel along paths that pass through the center position of the emitting electrode without being obstructed by the two signal lines that feed the emitting electrode.

13. The circularly polarized microstrip antenna according to claim 12, wherein the two signal lines extend from their respective edges of the back surface of the dielectric substrate to an intermediate position between their respective edges and the center position of the emitting electrode.

14. The circularly polarized microstrip antenna according to claim 12, wherein the dielectric substrate is composed of a dielectric material having a dielectric constant of 6 or more.

15. The circularly polarized micro strip antenna according to claim 12, wherein a width of the coplanar signal line is constant over an entire length thereof.

16. The circularly polarized microstrip antenna according to claim 12, wherein the coplanar signal line does not overlap the emitting electrode.

17. The circularly polarized microstrip antenna according to claim 12, wherein the dielectric substrate is square-shaped.

18. A radio communication apparatus comprising the circularly polarized microstrip antenna according to claim 12.

* * * * *